United States Patent [19]

Renger et al.

[11] Patent Number: 4,536,166

[45] Date of Patent: Aug. 20, 1985

[54] CAP FIRING ANIMATED FIGURE TOY

[75] Inventors: Larry H. Renger, Hawaiian Gardens; Mike T. McKittrick, Torrance, both of Calif.

[73] Assignee: Mattel, Inc., Hawthorne, Calif.

[21] Appl. No.: 688,931

[22] Filed: Jan. 3, 1985

[51] Int. Cl.[3] ..... A63H 3/28

[52] U.S. Cl. ..... 446/298; 446/336; 446/398

[58] Field of Search ..... 446/297, 298, 398, 404, 446/399, 418, 422, 303, 330, 333, 334, 335, 336, 376, 268, 270, 271, 272

[56] References Cited

U.S. PATENT DOCUMENTS

| | | | |
|---|---|---|---|
| 2,167,042 | 7/1939 | Geiser | 446/298 |
| 3,978,611 | 9/1976 | Strongin | 46/118 |
| 4,003,158 | 1/1977 | Wolf et al. | 446/334 |
| 4,182,075 | 1/1980 | James | 46/118 |

*Primary Examiner*—Mickey Yu

*Attorney, Agent, or Firm*—Ronald M. Goldman; Melvin A. Klein

[57] ABSTRACT

A figure toy with positionable appendages and having upper and lower torso portions pivotally interconnected with a spring member at the axis of pivoting. The rear of the torso is configured for retaining sound emitting devices, such as a plurality of caps, and a mechanism including a spring-biased hammer member is provided within the torso, the hammer member being cocked in response to pivoting in a first direction against the force of the spring of the upper torso relative to the lower torso. Upon release of the upper torso, the spring urges pivoting of the upper torso in the opposite direction, with a time delay mechanism suddenly releasing the hammer under force of its bias, near the end of travel in the opposite direction, to fire the cap, thus simulating the sound of a punch with the arm positioned to a punching position.

17 Claims, 11 Drawing Figures

34
40
54a
74
46a
46
50b
58
22
52
52a
76
56
48
50
46b
44c
75
40c
40b
67
50a
42
24c
40a
52
24

CAP FIRING ANIMATED FIGURE TOY

BACKGROUND OF THE INVENTION

The background of the invention will be discussed in two parts:

1. Field of the Invention

This invention relates to animated figure toys, and more particularly to an animated figure toy with a mechanism for producing sound, such as by firing caps.

2. Description of the Prior Art

Toy figures having posable or movable articulated limbs are very popular with children, with some such figures being referred to as action figures. Action figures usually have some distinguishing characteristics, such as being configured as the super hero type of figure, and usually such figures are provided with action accessories, such as vehicles and the like to enable the child to configure an action setting.

Some such action figures are provided with mechanisms within the torso, usually spring-actuated, to enable some form of action such as throwing a punch, in response to the operation of some control means, such as a depressible lever or the like. Some such figures are provided with sound emitting devices with the emission of sound coinciding with the movement of some portion of the anatomy of the figure.

One such device is shown and described in U.S. Pat. No. 3,978,611, issued Sept. 7, 1976 to Strongin for a "Toy Figure With Pistol Draw Action", this device including an articulated figure with the appearance of a cowboy having a gun attached to the hand, with a holster at the side of the figure. Upon operation of a lever, the pistol is withdrawn from the holster and extended to a firing position and a noise simulating the firing of a pistol is generated substantially concurrently with the pistol attaining the firing position, the noise being generated by a striker contacting a sound drum at the proper moment.

Another animated figure toy is shown and described in U.S. Pat. No. 4,182,075, entitled "Cap-firing Arm for a Figure Toy", issued Jan. 8, 1980 to James, and assigned to the assignee of the present invention. This patent discloses a figure having a mechanism within the arm for receiving a cap to be impacted by a spring-loaded hammer member, manually retractable by a lever passing through a slot in the arm. Other mechanism is provided and actuated by a depressible plate in the back of the figure to move the arm from a vertical position to a horizontal position, whereupon the hammer is released to fire the cap.

It is an object of the present invention to provide a new and improved articulated action figure with sound emission.

It is another object of the present invention to provide a new and improved cap-firing toy figure.

It is a further object of the present invention to provide a new and improved toy figure with a capfiring mechanism acuated in response to relative pivoting of the upper and lower torsos with the cap being fired upon forward movement of an arm thereof to simulate the throwing of a punch and the sound associated therewith.

SUMMARY OF THE INVENTION

The foregoing and other objects are accomplished by providing a figure toy with positionable appendages and having upper and lower torso portions pivotally interconnected with a spring member at the axis of pivoting. The rear of the upper torso is configured for retaining a plurality of caps, and a mechanism including a spring-biased hammer member is provided within the upper torso, the hammer member being cocked in response to pivoting in a first direction against the force of the spring member of the upper torso relative to the lower torso. Upon release of the upper torso, the spring member urges pivoting in the opposite direction, with a time delay mechanism suddenly releasing the hammer near the end of pivoting in the opposite direction under force of its bias, to fire the cap, thus simulating the sound of a punch with the arm positioned to a punching position.

Other objects, features and advantages of the invention will become apparent from a reading of the specification, when taken in conjunction with the drawings, in which like reference numerals refer to like elements in the several views.

DESCRIPTION OF THE PREFERRED EMBODIMENT

Figure 1:
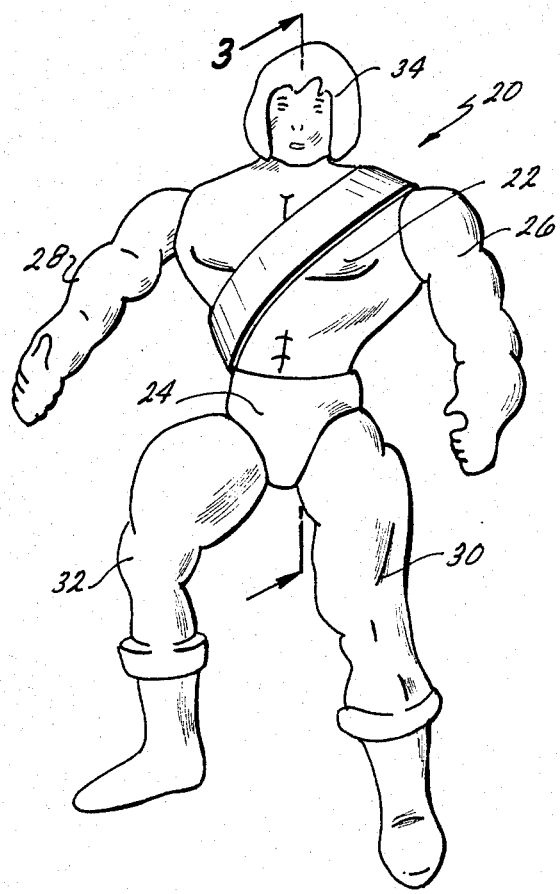
FIG. 1 is a perspective view of the cap firing animated figure toy according to the present invention.
Figure 6:
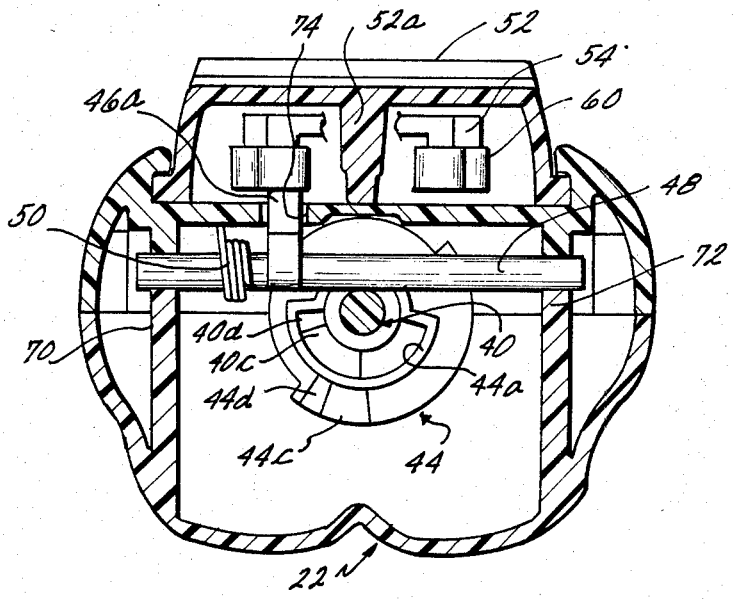
FIG. 6 is a cross-sectional view of the upper torso of FIG. 3 as viewed generally along line 6—6 thereof.

Referring now to the drawings, and particularly to FIG. 1, there is shown a toy figure, generally designated 20, having an upper torso 22, a lower torso 24, a pair of arms 26 and 28, a pair of legs 30 and 32, and a head 34. Each of the arms 26 and 28 is pivotally supported in or by the upper torso 22, at the shoulder portion (see, for example, FIG. 3), and although not shown, it is to be understood that each of the arms 26 and 28 may be bendable at the elbows, if desired, to enable posing of the figure. Similarly, the legs 30 and 32 are pivotally attached in or to the lower torso 24, and the legs, likewise, may be bendable at the knees.

As will be described, the upper and lower torsos 22 and 24 are pivotably interconnected, with the head 34 connected to the upper torso to a shaft secured in fixed relation to the lower torso.

Figure 2:
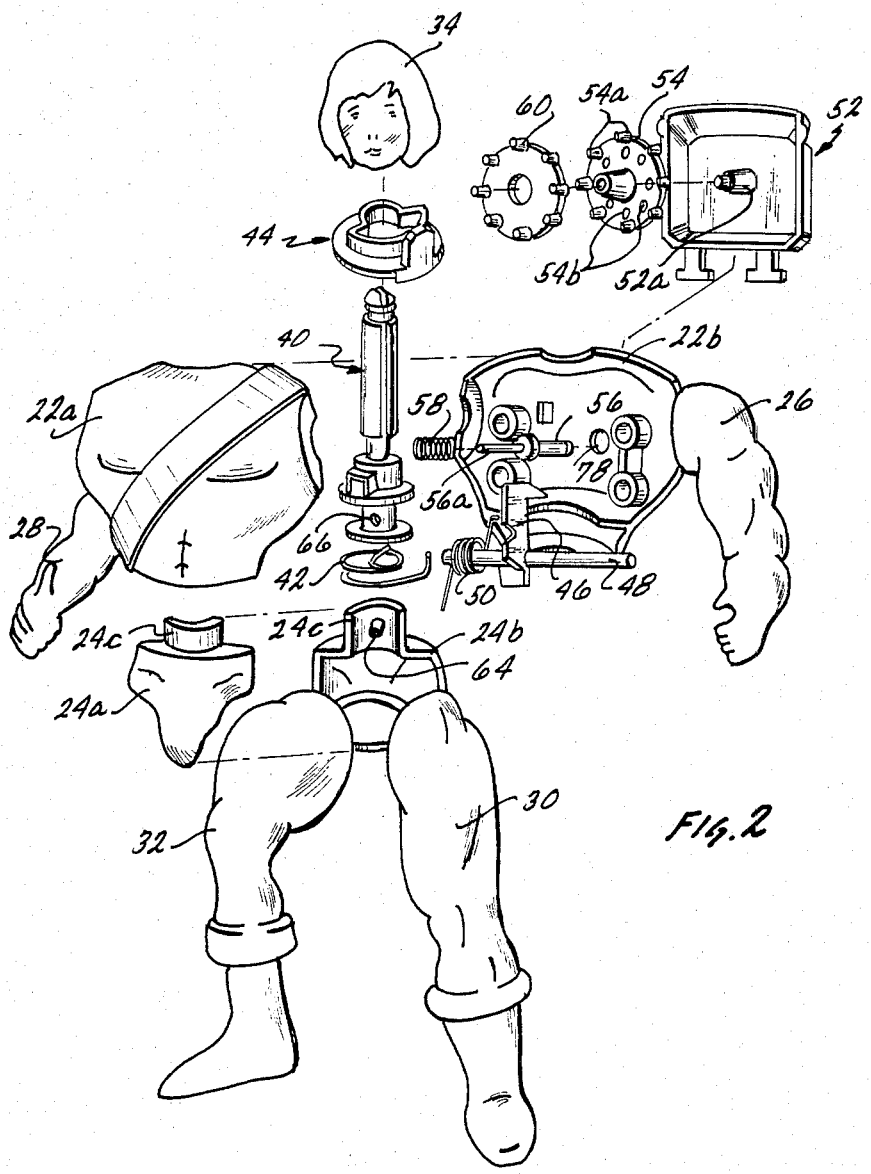
FIG. 2 is an exploded perspective view of the cap firing animated figure toy of FIG. 1.

Referring now to FIG. 2, the components of the figure toy 20 will be described. As shown, the upper torso 22 is formed of two parts, a front torso shell 22*a* and a rear torso shell 22*b*. Similarly, the lower torso 24 is formed of two parts, the front torso shell 24*a* and the rear torso shell 24*b*, with the attendant torso construction providing a generally hollow interior for receiving the mechanism.

The mechanism includes the following parts: a torso shaft, generally designated 40; a torso pivoting coil spring 42; a mechanical time delay holding member, generally designated 44; a generally L-shaped hammer member, generally designated 46; a hammer axle 48; a hammer spring 50; a cap housing cover 52; a cap anvil 54; an anvil detent member 56; and a detent spring 58. The caps 60 for use with the mechanism are of the ring shell type, that is the charge for each cap is contained within a cup or shell, and a plurality of caps are interconnected by an integrally formed web configured in the form of a ring.

The shaft 40 is secured to the lower torso 24 along the longitudinal center line of the figure toy 20, with the upper end configured for insertion into an opening in the head 34. For purposes of providing stability, the lower torso shells 24*a* and 24*b* are provided with an integrally formed generally tubular sleeve portion, collectively designated 24*c* (See also FIG. 3) with the shaft 40, at the lower end thereof being provided with a flanged neck portion 40*a*, this portion resting snugly within, and locked to, the sleeve portion 24*c*. For the purpose of locking the two parts together, the sleeve portion 24*c* is provided with an integrally formed boss portion 64 positioned and dimensioned for alignment with, and insertion into, an aperture 66 extending through the neck portion 40*a* of shaft 40.

Figure 4:
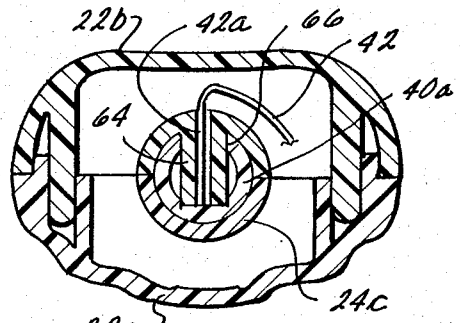
FIG. 4 is a cross-sectional view of the upper torso of FIG. 3 as viewed generally along line 4—4 thereof.
Figure 3:
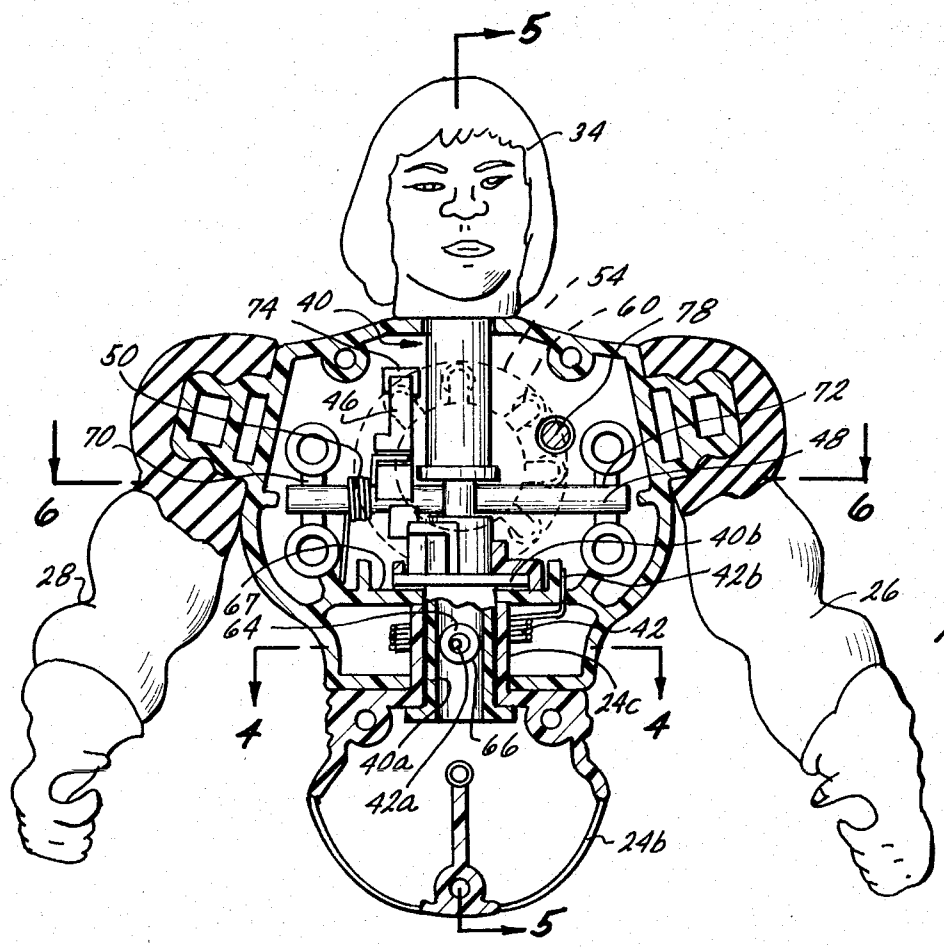
FIG. 3 is a partial cross-sectional view of the upper and lower torsos and of the arms and head of the animated figure toy of FIG. 1, as viewed generally along line 3—3 thereof, illustrating the interior mechanism.

A diametrically extending end 42*a* of the torso coil spring 42 is inserted into an axial opening in the boss portion 64, with the main body of the spring 42 encircling the sleeve portion 24*c*, the other end 42*b* of spring 42 being bent upwardly for fixedly securing within the upper torso 22 (See FIGS. 3 and 4). In this manner, one end 42*a* of the spring 40 is secured to the lower torso 24, while the other end 42*b* of the spring 40 is secured to the upper torso 22, preferably by the clamping between the two halves of the torso 22 upon assembly. As such, the upper torso 22 is pivotable relative to the lower torso 24 with the spring 42 biasing the parts in a given direction of pivoting or rotation. In this particular figure toy 20, the torso coil spring 42 is configured and installed to provide a spring return force in a counterclockwise direction when viewing the figure toy 20 from the top.

As shown in FIG. 3, the interior of the upper torso 22 is provided on the interior with various integrally formed structure for supporting the mechanical parts, such structure generally being formed during the molding of the torso parts at the appropriate locations, selected to enable the positioning of the parts in one portion of the torso, such as the rear shell 22*b* of the upper torso 22, with the other torso shell 22*a* being secured thereto as a cover. Such structure may include walls, or half bearings, with the other half of the bearing being formed in the other half of the torso. For example, a transversely extending wall portion 67 lies in proximate parallel relation to the plane formed at the junction of the upper and lower torsos 22 and 24, this wall 67 having an aperture formed therethrough for passage of the torso shaft 40. The shaft 40 has an enlarged flange portion 40*b* just above, and in proximate relation to the wall portion 67 of the upper torso 22, and thus in part, the adjacent surface of wall portion 67 acts as a bearing surface for this flange 40*b*, as well as an axial restraint.

Figure 7:
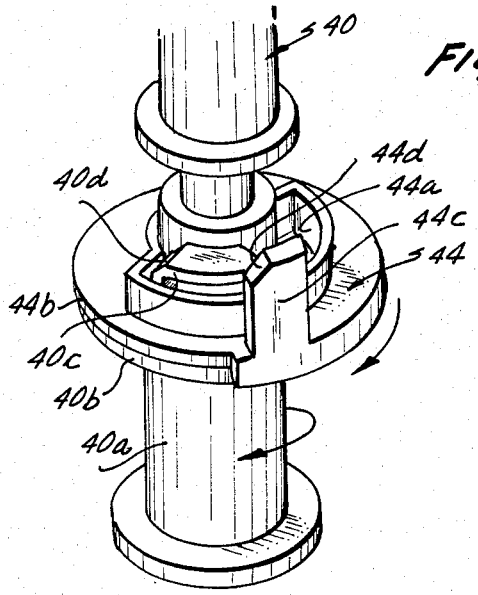
FIG. 7 is a perspective view of some of the actuating components of the cap firing mechanism used in the figure toy of FIG. 1.
Figure 8:
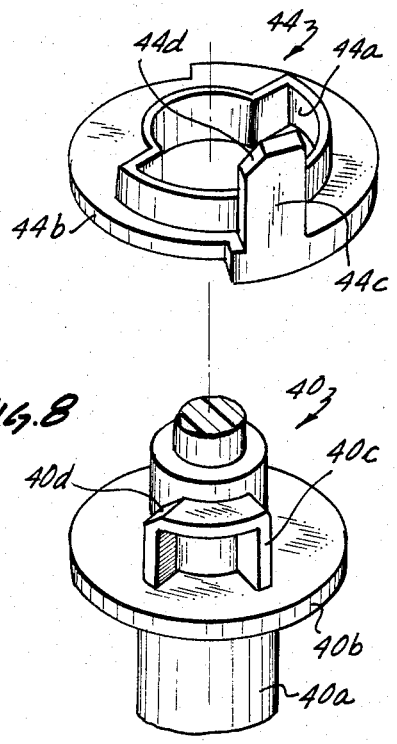
FIG. 8 is an exploded perspective view of the operative components illustrated in FIG. 7.
Figure 10:
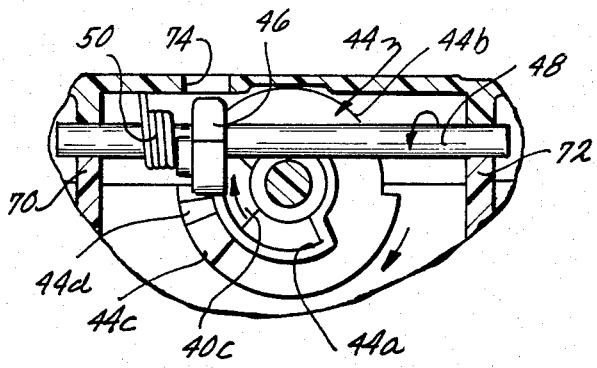
FIG. 10 is a partial cross-sectional view of the upper torso of FIG. 9, as viewed generally along line 10—10 thereof.
Figure 11:
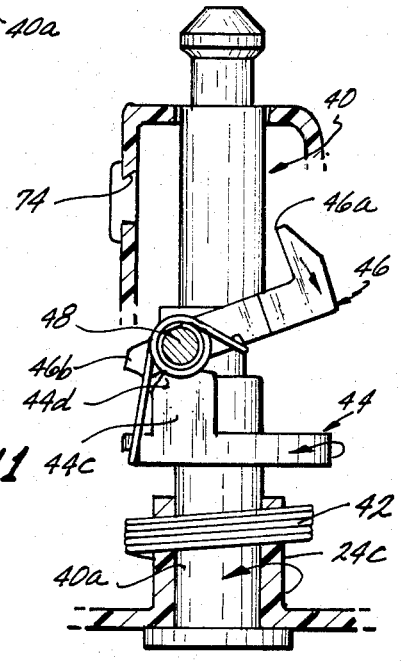
FIG. 11 is a side elevational view of the actuating components of the mechanism used in the animated figure of FIG. 1, showing the hammer in its latched position.

As more completely illustrated in FIGS. 7, 8 and 11, the flange 40*b* has formed integrally therewith, in the upper surface thereof, an arcuate stop member 40*c*, which coacts with an arcuate segmented opening 44*a* formed in the time delay holding member 44, the opening 44*a* being provided with a peripheral shoulder for stability during operation. The angle of the arc formed by the stop member 40*c* is approximately forty degrees, with the angle formed by the coacting opening 44*a* being approximately one hundred thirty degrees, thus allowing about forty-five degrees of pivotal displacement of the holding member 44 relative to the stop member 40*c*. As shown in FIGS. 7 and 8, the holding member 44 has the lower surface 44*b* thereof generally planar, and generally disc-shaped for slidable pivoting relation with the upper surface of flange portion 40*b*. When assembled, the stop member 40*c* extends into the opening 44*a* of the holding member 44.

The holding member 44 has an enlarged arcuate flange portion adjacent the periphery thereof with an axially extending catch arm 44*c* formed at the periphery thereof, the catch arm 44*c* having a beveled leading edge 44*d* in alignment with a similar beveled edge 40*d* in the stop member 40*c*. These edges are referred to as leading edges, since, as will be explained, these edges are configured for coaction with other portions of the mechanism during relative pivoting of the upper and lower torsos 22 and 24, respectively. As illustrated, with the arcuate portions in asssembled relation, the holding arm 44*c* extends above the height of the stop member 40*c*.

Figure 5:
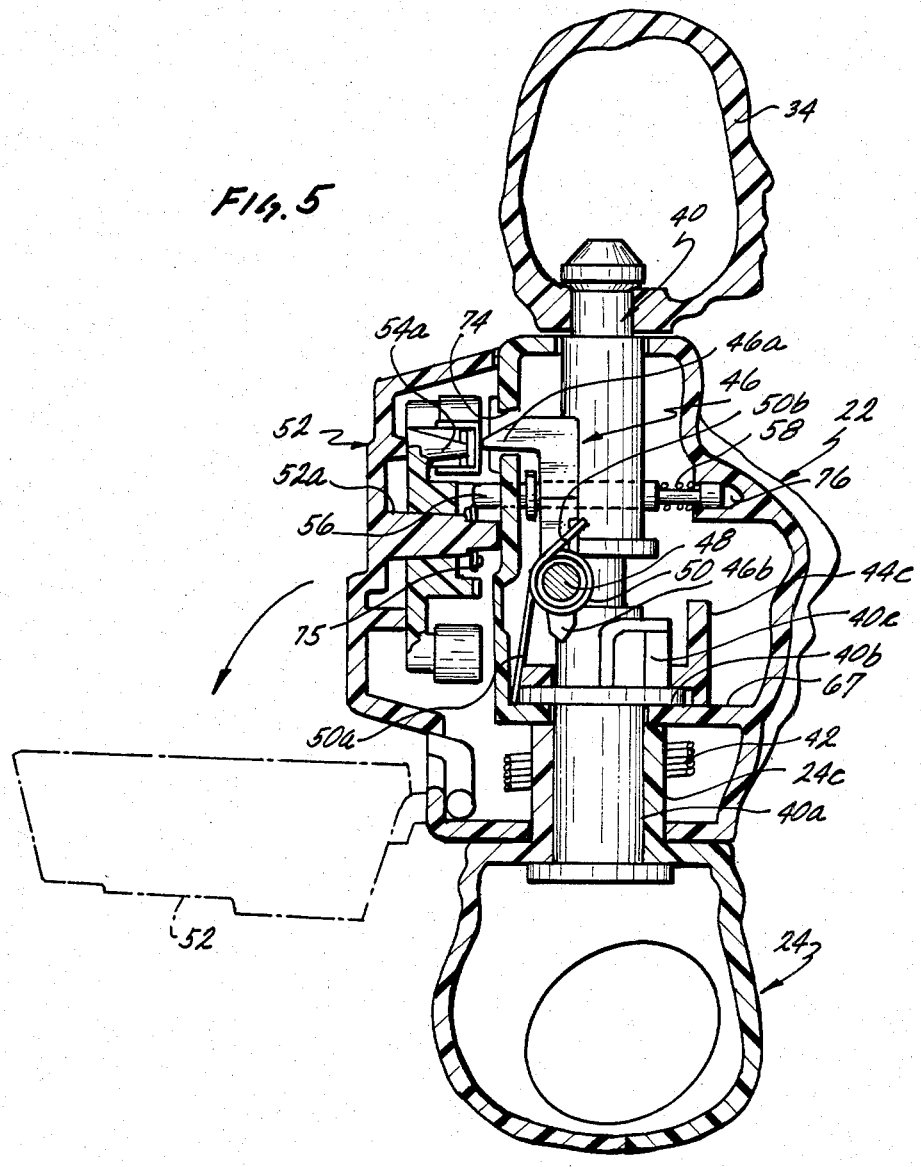
FIG. 5 is a cross-sectional view of the upper and lower torsos of FIG. 3 as viewed generally along line 5—5 thereof.

The hammer mechanism includes the hammer member 46 having the axle 48 extending transversely to the lower end thereof, the axle 48 preferably being integrally formed with the hammer member 46, and preferably formed of metal. The hammer member 46 has a long generally L-shaped leg terminating in the head 46*a* on one side of the intersection with the axle 48, and a short trip leg 46*b* extending in the opposite direction from the axle 48. The ends of the axle 48 are rotatably received within integrally formed spaced, generally parallel wall portions 70 and 72 (See FIG. 3) of upper torso 22, which are cut away to provide bearing surfaces. As shown, the axle 48 is positioned laterally within the upper torso 22 adjacent the rear wall thereof (See also FIG. 5), and the rear wall is provided with a generally rectangular opening or slot 74 through which extends the hammer head portion 46*a* for impact with the caps 60. As can be seen in FIG. 5, the main axis of the hammer member 46 lies in a generally vertical plane as viewed in the drawing with pivoting about a horizontal axis. The coil hammer spring 50 has the opening thereof encircling the axle 48 with one end 50*a* thereof abutting the inner lower portion of the rear wall of the upper torso 22, and the other end 50*b* engaging the back edge of the hammer member 46 to effectively urge the hammer member rearwardly, toward the caps, as shown in the drawings.

For facilitating insertion and manipulation of the caps 60, the rear portion of the torso has hingedly secured thereto the generally rectangular dished cap housing cover 52, which forms a compartment. The inside of the cover 52 has an integrally formed generally centrally located pivot boss 52*a* extending inwardly toward the rear wall of the upper torso 22. The cap anvil 54 is preferably metallic and has an enlarged central opening configured for engagement with the boss 52*a* for rotatable support of the anvil 54. The anvil 54 is retained on the boss 52*a* by a spring washer 75, or other similar means.

The anvil 54 includes a plurality of equiangularly spaced generally frusto-conically configured axially extending projections 54*a* on the periphery thereof, each of the projections being configured for positioning thereover one cap of the ring of caps 60 (See FIG. 5). On a circumference, inwardly of the projections 54*a*, anvil 54 includes a similar number of detent depressions 54*b*, each of which is configured for detenting therein of the end of the anvil detent member 56.

Figure 9:
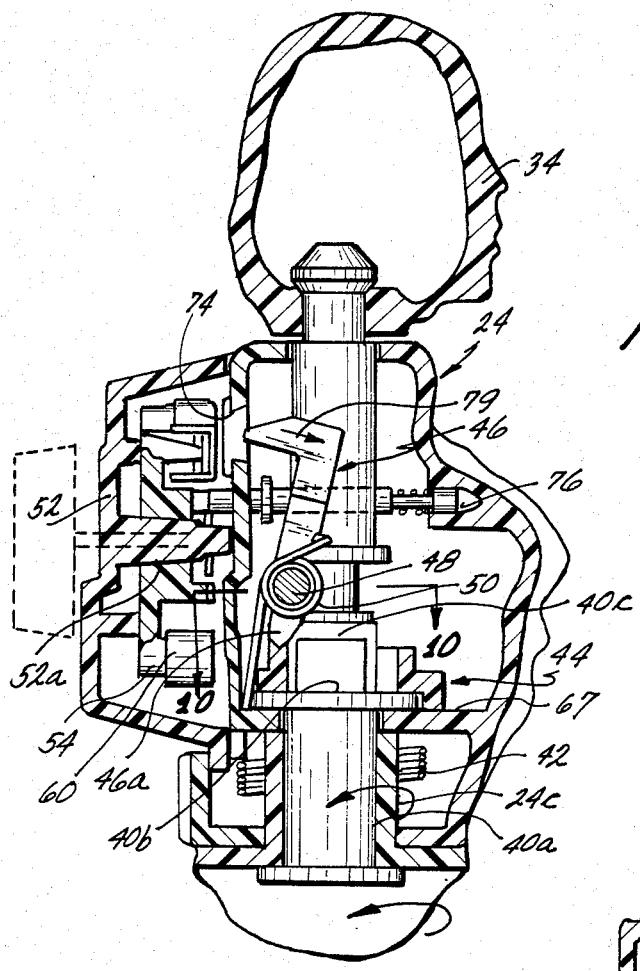
FIG. 9 is a partial cross-sectional view of the upper and lower torsos similar to FIG. 5, showing the cap firing hammer being moved to the cocked position.

For detenting, the detent member 56 has a reduced diameter shaft portion 56*a* over which is received the anvil detent coil spring 58. As depicted in FIGS. 3, 5 and 9, the detent member 56 has the reduced shaft portion 56*a* thereof received in an aperture 76 formed in a boss on the interior of the front upper torso shell 22*a*, with the other end of detent member 56 extending through an aperture 78 formed in the rear wall of the rear upper torso shell 22*b*. The detent member 56 extends in a direction generally perpendicular to the plane of the anvil member 54. The end of detent member 56 aligns with and engages an aligned one of the depressions 54*b*, to thus retain the anvil member 54 in position with a cap of ring caps 60 beneath the hammer head 46*a* of the hammer member 46.

Referring to FIGS. 6 through 11, the details pertaining to the actuation of the cocking and releasing mechanism for the hammer 46 will be described. Essentially, the shaft 40 remains fixed relative to the lower torso 24, and consequently flange 40*b* thereof and stop member 40*c* thereon are fixed in position relative to the lower torso 24. As shown in FIGS. 9 and 11, as either the lower or upper torsos are rotated with respect to each other a first increment in the direction, such as shown by the arrow thereabout, the flange 40*b* and stop member 40*c* are angularly displaced in the same direction with ramp portion 40*d* first coming into engagement with the lower trip arm 46*b* of the hammer member 46, thus commencing the pivoting of the hammer member 46 in a clockwise direction (as viewed in FIG. 9) as shown by the arrow 79 thereon (See also FIG. 5). This rotation of the torsos 22 and 24 relative to one another is effected against the force of the torso bias coil spring 42. The hammer member 46 pivots against the force of its bias spring 50 during this movement.

As the rotation continues, the forward edge of stop member 40*c* engages the leading shoulder of the opening 44*a* of the holding member 44, whereupon holding member 44 rotates concurrently with the flange 40*b*. The ramped edge of holding arm 44*c* contacts the trip arm 46*b* of hammer member 46 until, with the parts fully pivoted, the holding arm portion 44*c* lies generally beneath the axle 48 of the hammer member 46, thus holding the hammer member 46 into its fully cocked position shown against the force of its bias spring 50.

In order to release the hammer member 46, and thus actuate the firing of the caps 60, the upper torso 22 is released with the lower torso 24 held stationary. This causes the upper torso 24 to move in the opposite direction. During this movement, the holding member 44 would pivot relative to the flange 40*b* of the shaft 40, thus maintaining the engagement of the holding arm portion 44*c* with the trip arm 46*b* of the hammer member 46 during the first increment of pivoting. The pivoting in this opposite direction is caused by the return force of the torso bias coil spring 42. As the relative movement between the holding member 44 and flange 40*b* continues, eventually the trailing edge of the stop member 40*c* engages the trailing edge of the arcuate opening 44*a* of holding member 44. At this point, there has been a mechanical time delay in the action, that is the pivoting in the opposite direction has continued with no release of the hammer member 46, this time delay resulting from the angular difference between the arcuate stop member 40*d* within the arcuate slotted opening 44*a*.

As the holding member 44 moves concurrently with the flange 40*b* of the shaft 40, the holding arm portion 44*c* is suddenly removed from beneath the trip arm portion 46*b* of hammer member 46, thus enabling the sudden return of the hammer member 46 in a counter clockwise direction (as viewed in FIGS. 5 and 9) under force of its bias spring 50, with the hammer heed 46*a* passing through slot 74 into contact with one of the caps of the ring of caps 60. During this relative rotation of the torsos 22 and 24, it is preferable that the right arm 28 of the figure toy 20 be pivoted to a generally horizontal position, simulating the throwing of a punch.

With the actuating mechanism as shown and described, the arm 28 will reach the full extent of its swing virtually simultaneously with the discharge of the cap, thus simulating the sound of a punch. The relative displacement of rotation between the flange 40*b* and holdimg member 44 due to the stop member 40*c* having less of an an arcuate segment than the arcuate opening 44*a* provides an effective time delay, while enabling the sudden release of the hammer member 46 to promote the illusion of contact on the end of the punch.

One means for positioning of the next cap of the caps 60 in firing position, occurs when the child opens the rear compartment by pivoting of cap housing cover 52, then rotates the cap ring 60 and anvil 54, then closes the cover 52, whereupon the detent member 56 has the end thereof so dimensioned that it essentially fits closely between adjacent cap segments to then detent into one of the anvil detent depressions 54*b* for aligning the next cap segment for impact with the hammer head 46*a* of the hammer member 46. Another positioning means is shown in FIG. 5. A knob 80 is positioned on the exterior of the cover 52 and extends inside for rotating the cap anvil member 54. Other detent means (not shown) such as a detent washer, a pawl arrangement, or the like, could also be conveniently provided within the cover 52.

While there has been shown and described a preferred embodiment, it is to be understood that various other adaptations and modifications may be made within the spirit and scope of the invention.

We claim:

1. In a cap-firing figure toy, the combination comprising:

an upper torso having at least one arm member pivotally coupled thereto;

a hammer member movably mounted in said upper torso;

means connected to said upper torso for positioning at least one cap for impact by said hammer member;

means in said upper torso biasing said hammer member in a direction toward said at least one cap;

a lower torso rotatably connected to said upper torso;

means operatively interconnecting said hammer member and said lower torso in a manner such that relative pivoting of said upper and lower torsos in a first direction moves said hammer member against the force of its bias and relative pivoting of said torsos in an opposite direction actuates said hammer under force of its bias into contact with said at least one cap, said interoperative interconnecting means including means for delaying actuation of said hammer member until the relative pvioting of said torsos in the opposite direction is substantially complete whereby with said at least one arm extended the firing of a cap at the end of pivoting simulates the sound of a punch.

2. In a cap-firing figure toy, the combination comprising:

an upper torso;

a hammer member movably mounted in said upper torso;

means connected to said upper torso for positioning at least one cap for impact by said hammer member;

means in said upper torso biasing said hammer member in a direction toward said at least one cap;

a lower torso connected for rotation relative to said upper torso about the longitudinal centerline of said figure toy;

means operatively interconnecting said hammer member and said lower torso in a manner such that relative pivoting of said upper and lower torsos in a first direction moves said hammer member against the force of its bias and relative pivoting of said torsos in an opposite direction actuates said hammer under force of its bias into contact with said at least one cap.

3. The combination according to claim 2 wherein said toy further includes spring means biasing said upper and lower torsos in said opposite direction, and the pivoting in said opposite direction is caused by said spring means.

4. In a cap-firing figure toy, the combination comprising:

an upper torso having at least one arm member pivotally coupled thereto;

a hammer member movably mounted in said upper torso;

means connected to said upper torso for positioning at least one cap for impact by said hammer member;

means in said upper torso biasing said hammer member in a direction toward said at least one cap;

spring means biasing said upper and lower torsos in a first direction;

a lower torso rotatably connected to said upper torso;

means operatively interconnecting said hammer member and said lower torso in a manner such that relative pivoting of said upper and lower torsos in a first direction moves said hammer member against the force of its bias and relative pivoting of said torsos in a direction opposite to said first direction under force of said spring means actuates said hammer under force of its bias into contact with said at least one cap, said interoperative interconnecting means including means for delaying actuation of said hammer member until the relative pivoting of said torsos in the opposite direction is substantially complete whereby with said at least one arm extended the firing of a cap at the end of pivoting simulates the sound of a punch.

5. The combination according to claim 4 wherein said means connected to said upper torso for positioning at least one cap includes means for retaining a plurality of caps.

6. The combination according to claim 4 wherein said means connected to said upper torso for positioning at least one cap includes a cover means hingedly coupled to the rear of said upper torso and anvil means rotatably coupled to said cover means for supporting a plurality of caps.

7. The combination according to claim 6 wherein said anvil means is rotatable and indexable for positioning a preselected cap in position for impact by said hammer member.

8. The combination according to claim 7 wherein said means for biasing said hammer member includes spring means.

9. In a cap-firing figure toy, the combination comprising:

an upper torso;

a hammer member movably mounted in said upper torso;

means connected to said upper torso for positioning at least one cap for impact by said hammer member, said means including a cover means hingedly coupled to the rear of said upper torso and anvil means rotatably coupled to said cover means for supporting a plurality of caps;

means in said upper torso biasing said hammer member in a direction toward said at least one cap;

a lower torso rotatably connected to said upper torso;

means operatively interconnecting said hammer member and said lower torso in a manner such that relative pivoting of said upper and lower torsos in a first direction moves said hammer member against the force of its bias and relative pivoting of said torsos in an opposite direction actuates said hammer under force of its bias into contact with said at least one cap.

10. The combination according to claim 9 wherein said toy further includes at least one arm member pivotally coupled to said upper torso, and said interoperative interconnecting means includes means for delaying actuation of said hammer member until the relative pivoting of said torsos in the opposite direction is substantially complete whereby with said at least one arm extended the firing of a cap at the end of pivoting simulates the sound of a punch.

11. in a cap-firing figure toy, the combination comprising:

upper torso means;

lower torso means connected for rotation relative to said upper torso means about the longitudinal centerline of said figure toy;

a cap-firing mechanism mounted in said upper torso means, said cap-firing mechanism including a hammer member and means for feeding caps past said hammer member; and means interconnecting said hammer member to said lower torso means in a hammer such that said cap-firing mechanism may be caused to fire caps by relative pivoting of said torso means to actuate said cap-firing mechanism said interconnecting means including means for relatively biasing said torso means in said second direction and further includes means for cocking said hammer member when said torso means are rotated with respect to each other in a first direction and for releasing said hammer member when said torso means are rotated with respect to each other in a second direction.

12. In a cap-firing figure toy, the combination comprising:

upper torso means having at least one arm member pivotally coupled thereto;

lower torso means rotatably connected to said upper torso means;

a cap-firing mechanism mounted in said upper torso means, said cap-firing mechanism including a hammer member and means for feeding caps past said hammer member; and means interconnecting said hammer member to said lower torso means in a manner such that said cap-firing mechanism may be caused to fire caps by relative pivoting of said torso means to actuate said cap-firing mechanism, said interoperative interconnecting means including means for delaying actuation of said hammer member until the relative pivoting of said torsos in said opposite direction is substantially complete whereby with said at least one arm extended the firing of a cap at the end of pivoting simulates the sound of a punch.

13. In a figure toy, the combination comprising:

upper torso means having at least one arm member pivotally coupled thereto lower torso means connected to said upper torso means for providing relative pivotal movement therebetween;

spring means interconnecting said upper and lower torso means;

hammer means mounted in one of said upper and lower torso means, said hammer means being actuable between first and second positions;

other means mounted in one of said upper and lower torso means for contact by said hammer means in said first position; and means within said torso means operatively interconnected with said hammer means for actuation thereof to said second position upon relative pivoting of said torso means against the force of said spring means and for enabling return of said hammer means to said first position on relative pivoting of said torso means under force of said spring means for enabling impact of said hammer means with said other means for emitting sound, and said operatively interconnected means including means for delaying actuation of said hammer means until the relative pivoting of said torso means in said second direction is substantially complete whereby with said at leaqt one arm extended the contact of said hammer means in said first position with said other means simulates the sound of a punch.

14. The combination according to claim 13 wherein said hammer means and said other means are mounted in said upper torso means.

15. The combination according to claim 14 wherein said other means includes means for retaining at least one cap for contact by said hammer means in said first position.

16. The combination according to claim 13 wherein said hammer means is spring-biased to said first position.

17. The combination according to claim 16 wherein said other means includes means for retaining at least one cap for contact by said hammer means in said first position.

* * * * *